US009159204B2

(12) United States Patent
Yonemaru

(10) Patent No.: US 9,159,204 B2
(45) Date of Patent: Oct. 13, 2015

(54) CASH DRAWER CAPABLE OF PREVENTING LOSS OF BANKNOTES

(71) Applicant: NEC PLATFORMS, LTD., Kawasaki-shi, Kanagawa (JP)

(72) Inventor: Shinichirou Yonemaru, Kanagawa (JP)

(73) Assignee: NEC Platforms, Ltd., Kanagawa (JP)

( * ) Notice: Subject to any disclaimer, the term of this patent is extended or adjusted under 35 U.S.C. 154(b) by 0 days.

(21) Appl. No.: 14/419,162

(22) PCT Filed: Jul. 19, 2013

(86) PCT No.: PCT/JP2013/070258
§ 371 (c)(1),
(2) Date: Feb. 2, 2015

(87) PCT Pub. No.: WO2014/027557
PCT Pub. Date: Feb. 20, 2014

(65) Prior Publication Data

US 2015/0206401 A1 Jul. 23, 2015

(30) Foreign Application Priority Data

Aug. 16, 2012 (JP) ..... 2012-180532

(51) Int. Cl.
*G06G 1/00* (2006.01)
*G07G 1/00* (2006.01)

(52) U.S. Cl.
CPC ..... *G07G 1/0027* (2013.01)

(58) Field of Classification Search
CPC ..... G07G 1/0018; G06G 1/0027
USPC ..... 235/7 R, 383
See application file for complete search history.

(56) References Cited

U.S. PATENT DOCUMENTS

| | | | | |
|---|---|---|---|---|
| 5,451,753 | A * | 9/1995 | Leatherwood et al. | 235/7 R |
| 6,719,196 | B2 * | 4/2004 | Fukuyama | 235/7 R |
| 6,929,178 | B2 * | 8/2005 | Moriya et al. | 235/381 |
| 7,533,797 | B2 * | 5/2009 | Stulz et al. | 235/22 |

(Continued)

FOREIGN PATENT DOCUMENTS

| | | | |
|---|---|---|---|
| JP | 63-268091 | A | 11/1988 |
| JP | 07-57154 | A | 3/1995 |

(Continued)

OTHER PUBLICATIONS

Notification of Reson(s) for Rejection of JP 2012-180532 dated Oct. 22, 2012.

(Continued)

*Primary Examiner* — Seung Lee
(74) *Attorney, Agent, or Firm* — Sughrue Mion, PLLC

(57) ABSTRACT

Provided is a cash drawer (10) including a drawer (70) having a banknote container (81) formed therein, and a cash drawer body (20). The cash drawer body (20) includes a drawer accommodating portion (21), a front opening portion (22), a top surface member (40) including a top surface section (41), and a front surface member (50) including a front frame section (51). The front surface member (50) and the top surface member (40) are coupled to each other without forming, at a position between the front surface member (50) and the top surface member (40), a seam extending in a direction being parallel to the top surface of the drawer accommodating portion (21) and intersecting a first direction (X).

5 Claims, 13 Drawing Sheets

(56) References Cited

U.S. PATENT DOCUMENTS

| | | | | |
|---|---|---|---|---|
| 7,992,768 | B2 * | 8/2011 | Benigno et al. | 235/7 R |
| 8,317,083 | B2 * | 11/2012 | Specht | 235/7 R |
| 2006/0054678 | A1 * | 3/2006 | Chang | 235/7 R |
| 2007/0095885 | A1 * | 5/2007 | Liang | 235/7 R |

FOREIGN PATENT DOCUMENTS

JP 2008-074606 A 4/2008

JP 2010-015511 A 1/2010

OTHER PUBLICATIONS

Written Opinion of the International Searching Authority of PCT/JP2013/070258 dated Oct. 29, 2013.

International Search Report of PCT/JP2013/070258 dated Oct. 29, 2013.

* cited by examiner

CASH DRAWER CAPABLE OF PREVENTING LOSS OF BANKNOTES

CROSS REFERENCE TO RELATED APPLICATIONS

This is a National Stage of International Application No. PCT/JP2013/070258 filed Jul. 19, 2013, claiming priority based on Japanese Patent Application No. 2012-180532 filed Aug. 16, 2012, the contents of all of which are incorporated herein by reference in their entirety.

TECHNICAL FIELD

This invention relates to a cash drawer including a drawer having a banknote container formed therein, and a cash drawer body for accommodating the drawer in a state of being movable in and out, and more particularly, to a cash drawer including a cash drawer body constructed of a plurality of parts.

BACKGROUND ART

Hitherto, there has been known a cash drawer including a drawer having a banknote container formed therein, and a cash drawer body for accommodating the drawer in a state of being movable in and out (see, for example, Patent Document 1).

In general, the cash drawer body is required to be manufactured easily at low cost, and hence the cash drawer body is often constructed of a plurality of parts in combination.

PRIOR ART DOCUMENT

Patent Document

Patent Document 1: JP-A-563-268091

SUMMARY OF THE INVENTION

Problems to be Solved by the Invention

Now, referring to a cash drawer 110 of a reference example illustrated in FIGS. 11 to 14, description is given of problems that may be caused when a cash drawer body 120 is constructed of a plurality of parts.

First, as illustrated in FIGS. 13 and 14, the cash drawer 110 of the reference example includes a drawer 170 having a banknote container 181 formed therein, and the cash drawer body 120 for accommodating the drawer 170 in a state of being movable in and out along a first direction X.

As illustrated in FIGS. 11 and 12, the cash drawer body 120 includes a top surface member 140 including a top surface section 141 for defining a top surface of a drawer accommodating portion 121 of the cash drawer body 120, and a front surface member 150 including a front frame section 151 for defining edge portions of a front opening portion 122 of the cash drawer body 120. As illustrated in FIGS. 11 and 12, the front frame section 151 includes a bottom surface-side frame portion 151*a*, two lateral surface-side frame portions 151*b*, and a top surface-side frame portion 151*c* for defining four sides of the rectangular front opening portion 122.

On the other hand, as illustrated in FIG. 13, the drawer 170 includes a cash tray 180 including a banknote container 181, a banknote retainer 183 for retaining a banknote B contained in the banknote container 181, and a banknote guide portion 184 formed on the cash tray 180, for guiding the banknote B.

In the cash drawer 110 of the reference example, as illustrated in FIGS. 11 and 12, the top surface-side frame portion 151*c* of the front frame section 151 is arranged on the front surface side of the top surface section 141 of the top surface member 140. For that reason, at the top surface of the drawer accommodating portion 121, seams C each extending along a second direction Y intersecting the first direction X are formed between the top surface-side frame portion 151*c* and the top surface section 141.

In the cash drawer 110 of the reference example, which is constructed as described above, the seams C each extending along the second direction Y are formed at the top surface of the drawer accommodating portion 121, and hence, when the drawer 170 is moved into and out of the cash drawer body 120, the banknote B contained in the banknote container 181 may be caught on the seam C. The situation where the banknote B is caught on the seam C may cause such a phenomenon that the banknote B is slipped into a space on a rear side of the drawer 170, resulting in a loss of the banknote B.

Now, referring to FIGS. 13 and 14, detailed description is given of a process of losing the banknote B due to the seam C.

First, during operation of the cash drawer 110, as indicated by <STATE 1> of FIG. 13, the banknote B may be retained by the banknote retainer 183 under a state in which a distal end of the banknote B protrudes to a position above an upper end of the banknote guide portion 184.

Then, under the state in which the banknote B protrudes to the position above the upper end of the banknote guide portion 184, the drawer 170 is returned into the cash drawer body 120 as indicated by <STATE 2> of FIG. 13, and then the drawer 170 is pulled out as indicated by <STATE 3> of FIG. 13. In this case, in the middle of pulling out the drawer 170, the distal end of the banknote B is caught on the seam C formed at the top surface of the drawer accommodating portion 121.

Then, under the state in which the banknote B is caught on the seam C, the drawer 170 is pulled to the outside as indicated by <STATE 4> of FIG. 14, and then the drawer 170 is returned into the cash drawer body 120 as indicated by <STATE 5> of FIG. 14. In this case, the state in which the banknote B is caught on the seam C still remains unchanged, and hence the banknote B is released from the banknote retainer 183 in the middle of returning the drawer 170.

Then, under the state in which the banknote B is caught on the seam C and released from the banknote retainer 183, the drawer 170 is pulled to the outside as indicated by <STATE 6> of FIG. 14. In this case, the banknote B is slipped into the space on the rear side of the drawer 170.

In view of the above, this invention has been made to solve the problems inherent in the related art, that is, this invention has an object to provide a cash drawer capable of preventing a loss of a banknote during operation of the cash drawer.

Means to Solve the Problems

In order to solve the above-mentioned problems, according to one embodiment of this invention, there is provided a cash drawer, including: a drawer; and a cash drawer body for accommodating the drawer in a state of being movable in and out along a first direction, the drawer including a banknote container for containing a banknote, the cash drawer body including: a drawer accommodating portion for accommodating the drawer; a front opening portion formed at one end of the drawer accommodating portion and opened to an outside; a top surface member including a top surface section for defining a top surface of the drawer accommodating portion; and a front surface member including a front frame section for defining an edge portion of the front opening portion, the front surface member and the top surface member being coupled to each other without forming, as seen in a direction orthogonal to the top surface of the drawer accommodating portion, at a position between the front surface member and the top surface member, a seam extending in a direction being parallel to the top surface of the drawer accommodating portion and intersecting the first direction in a region of the top surface of the drawer accommodating portion, through which the banknote container passes when the drawer is moved in and out.

Effect of the Invention

According to the cash drawer of the one embodiment of this invention, it is possible to avoid such a risk that, during the operation of the cash drawer, the banknote contained in the banknote container is caught on the seam formed at the top surface of the drawer accommodating portion. As a result, it is possible to prevent the loss of the banknote, which may be caused by the situation where the banknote is caught on the seam formed at the top surface of the drawer accommodating portion.

MODE FOR EMBODYING THE INVENTION

Now, a cash drawer according to one embodiment of this invention is described with reference to the drawings.

Note that, in the following description, a direction parallel to a top panel of a drawer accommodating portion, for moving a drawer into and out of a cash drawer body is defined as a first direction X; a direction parallel to the top panel of the drawer accommodating portion and orthogonal to the first direction X, a second direction Y; and a direction orthogonal to the first direction X and the second direction Y, a third direction Z.

Embodiment

A cash drawer 10 is configured to store banknotes B and coins (not shown). In this embodiment, the cash drawer 10 is built into a POS device (not shown) for use.

Figure 1:
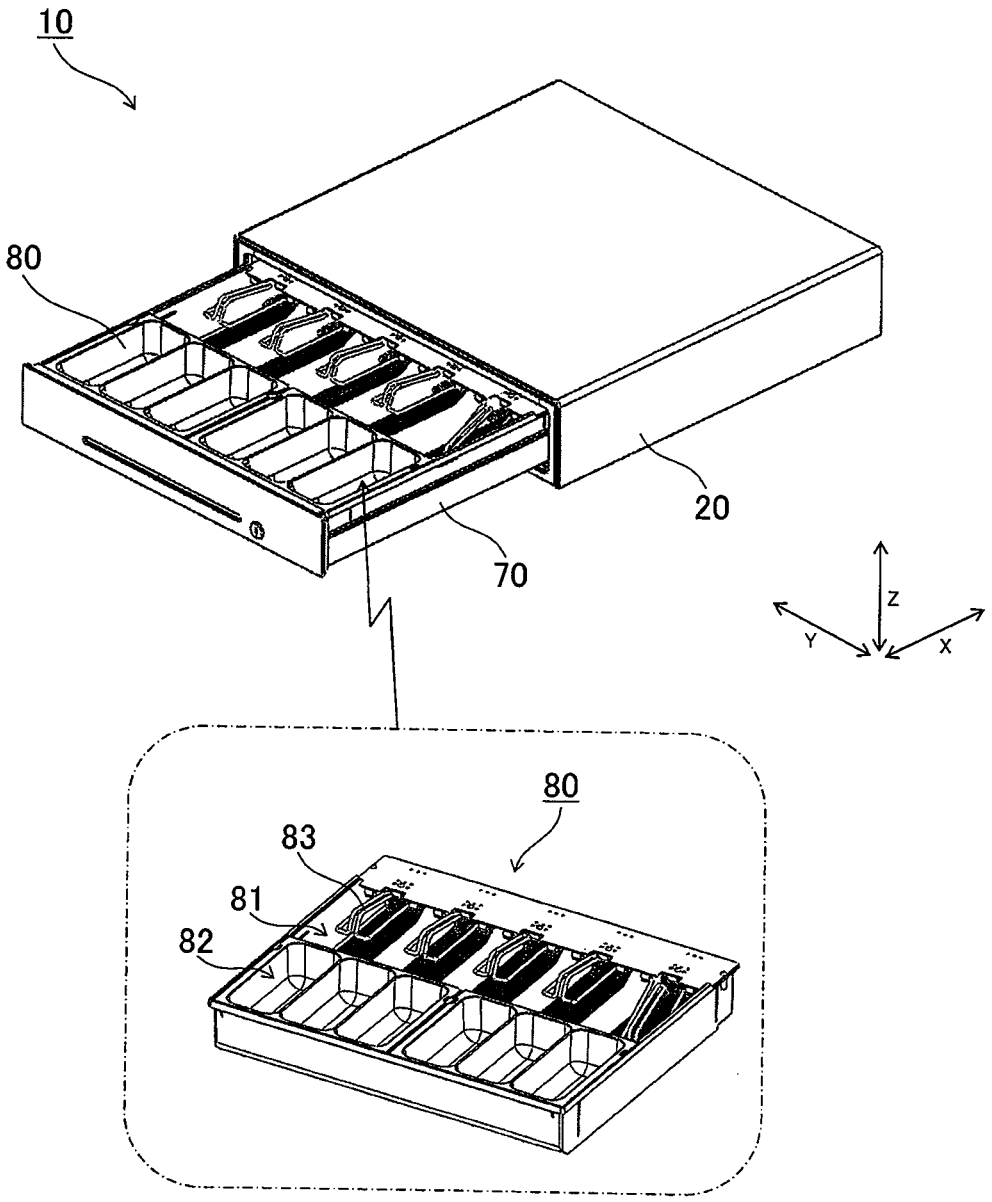
FIG. 1 is an explanatory view illustrating a cash drawer according to one embodiment of this invention.

As illustrated in FIG. 1, the cash drawer 10 includes a drawer 70, and a cash drawer body 20 for accommodating the drawer 70 in a state of being movable in and out along the first direction X.

Figure 2:
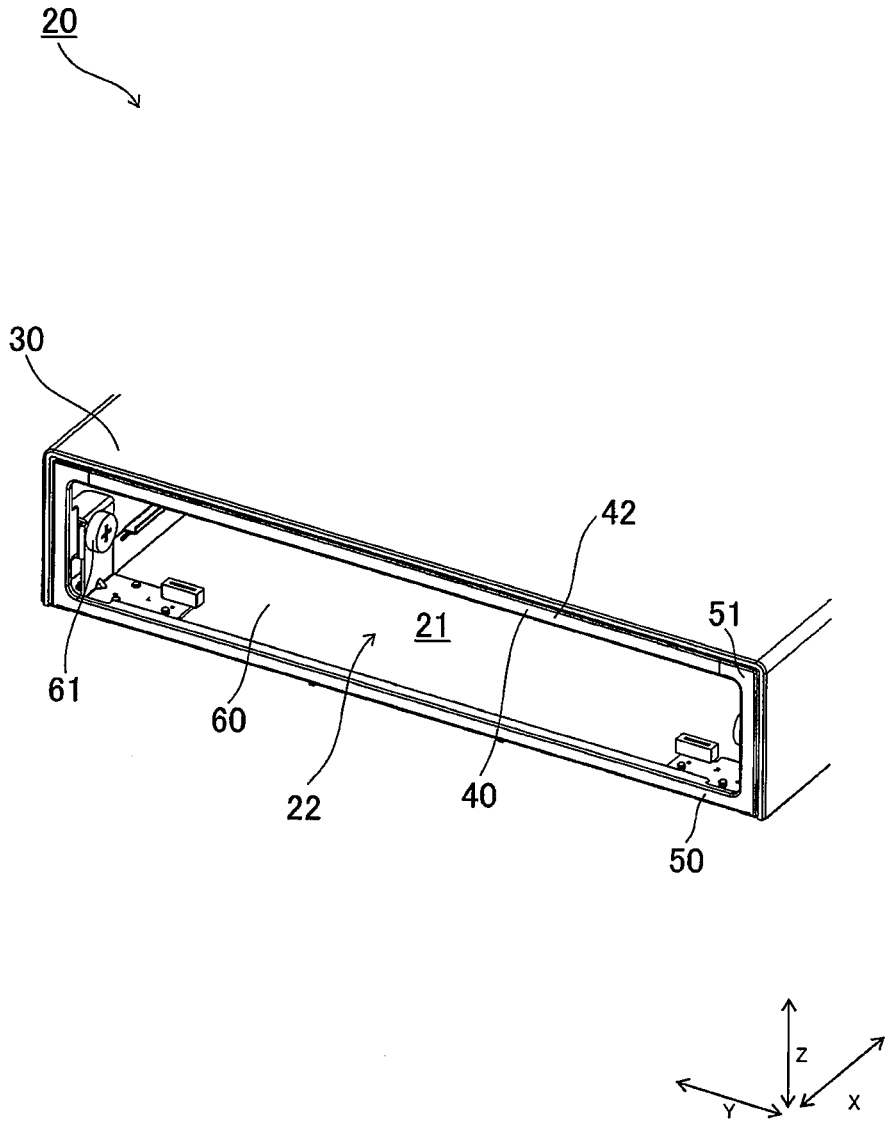
FIG. 2 is a perspective view illustrating a cash drawer body.
Figure 3:
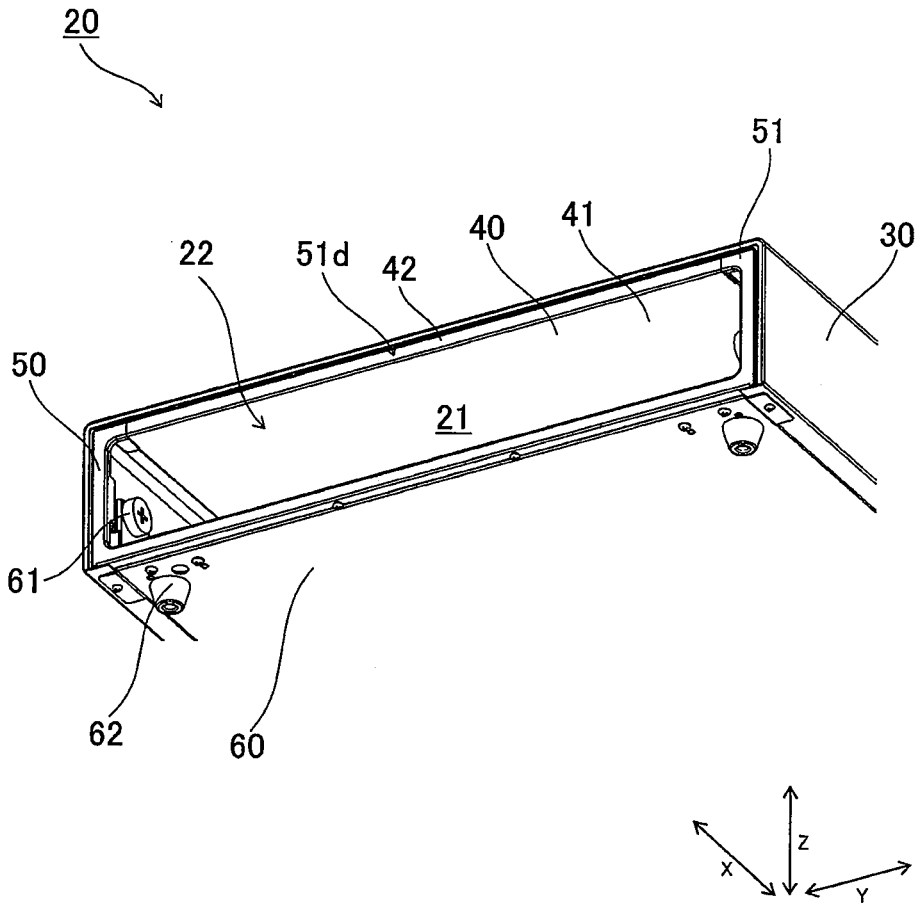
FIG. 3 is a perspective view illustrating the cash drawer body as seen at an angle different from that of FIG. 2.

As illustrated in FIGS. 2 and 3, the cash drawer body 20 includes a drawer accommodating portion 21 for accommodating the drawer 70, and a front opening portion 22 formed at one end of the drawer accommodating portion 21 and opened to the outside.

As illustrated in FIGS. 2 and 3, the cash drawer body 20 is constructed of a body cover 30, a top surface member 40, a front surface member 50, and a bottom chassis 60, which define the drawer accommodating portion 21 and the front opening portion 22 in cooperation with each other.

Figure 4:
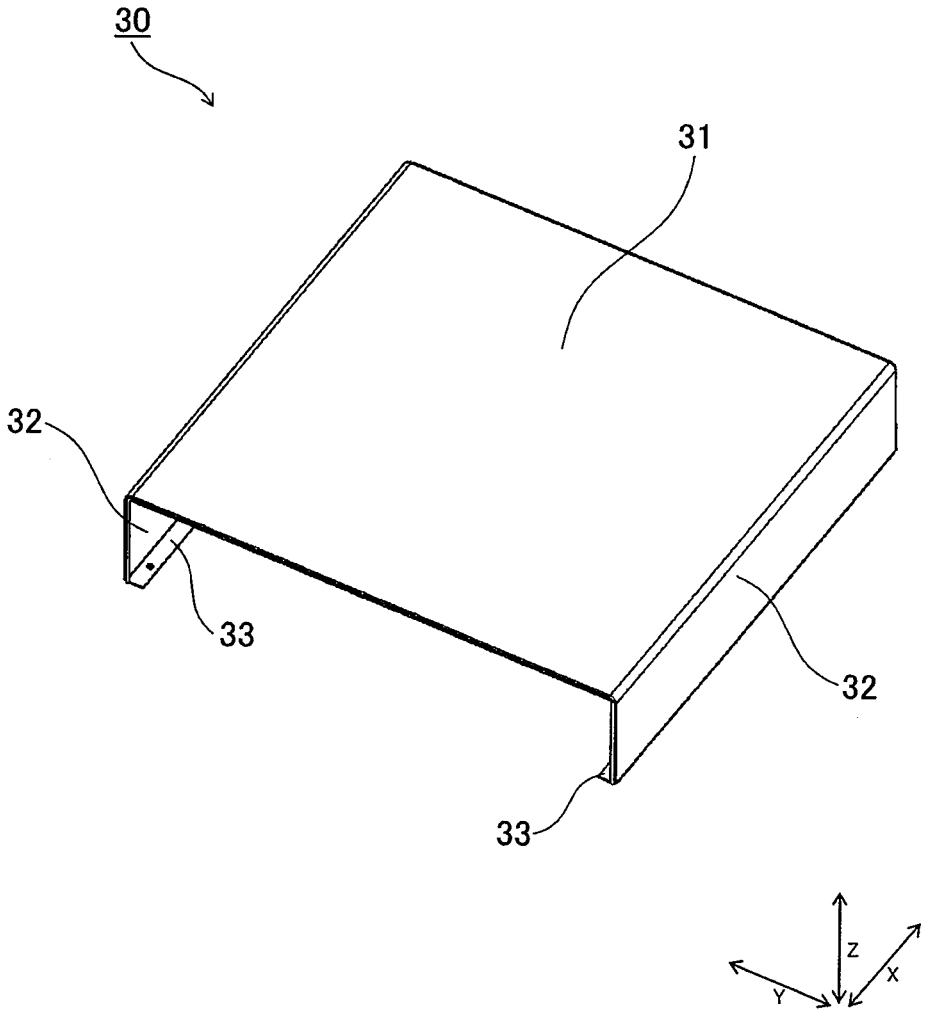
FIG. 4 is a perspective view illustrating a body cover.

As illustrated in FIG. 4, the body cover 30 is shaped by bending a sheet metal formed into a predetermined shape at predetermined positions.

As illustrated in FIG. 4, the body cover 30 integrally includes a top surface-side cover section 31 for covering a top surface side of the cash drawer body 20, a pair of lateral surface-side cover sections 32 for covering a lateral surface side of the cash drawer body 20, and assembling plate sections 33 formed at lower edges of the lateral surface-side cover sections 32, respectively.

Figure 5:
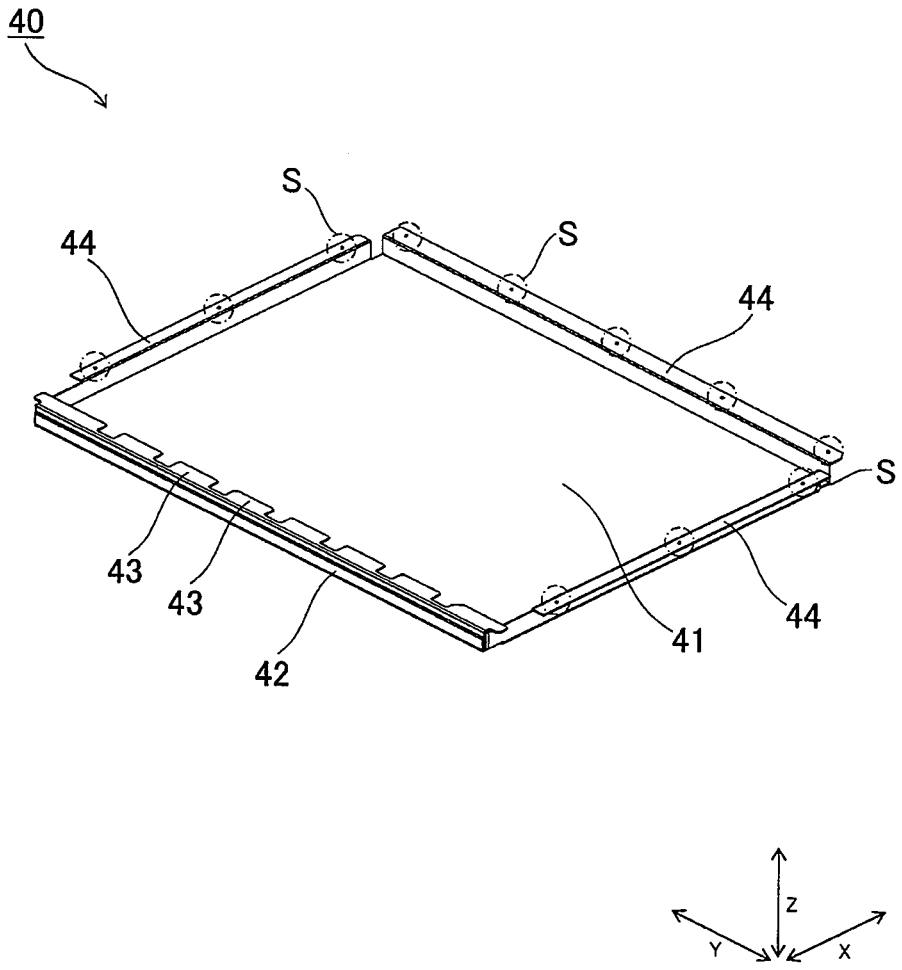
FIG. 5 is a perspective view illustrating a top surface member.

As illustrated in FIG. 5, the top surface member 40 is shaped by bending a sheet metal formed into a predetermined shape at predetermined positions.

The top surface member 40 is spot-welded at spot welding portions S illustrated in FIG. 5, thereby being joined to the body cover 30.

As illustrated in FIG. 5, the top surface member 40 includes a top surface section 41 for defining a top surface of the drawer accommodating portion 21, a frame section 42 formed continuously with an edge portion of the top surface section 41 on a front surface side, for defining an edge portion of the front opening portion 22 together with a front frame section 51 of the front surface member 50, a plurality of assembling protrusion sections 43, which protrude rearward from an upper edge of the frame section 42, and three assembling plate sections 44 formed at edge portions of the top surface section 41 other than the edge portion on the front surface side.

As illustrated in FIG. 3, under a state in which the top surface member 40 and the front surface member 50 are assembled to each other, the edge portion of the top surface section 41 on the front surface side is inserted to a top surface-side cutout portion 51*d* of the front frame section 51 described later so as to reach the front surface side of the cash drawer body 20.

In the second direction Y, the top surface section 41 of the top surface member 40 has a width dimension for covering a banknote container 81 of the drawer 70.

Figure 6:
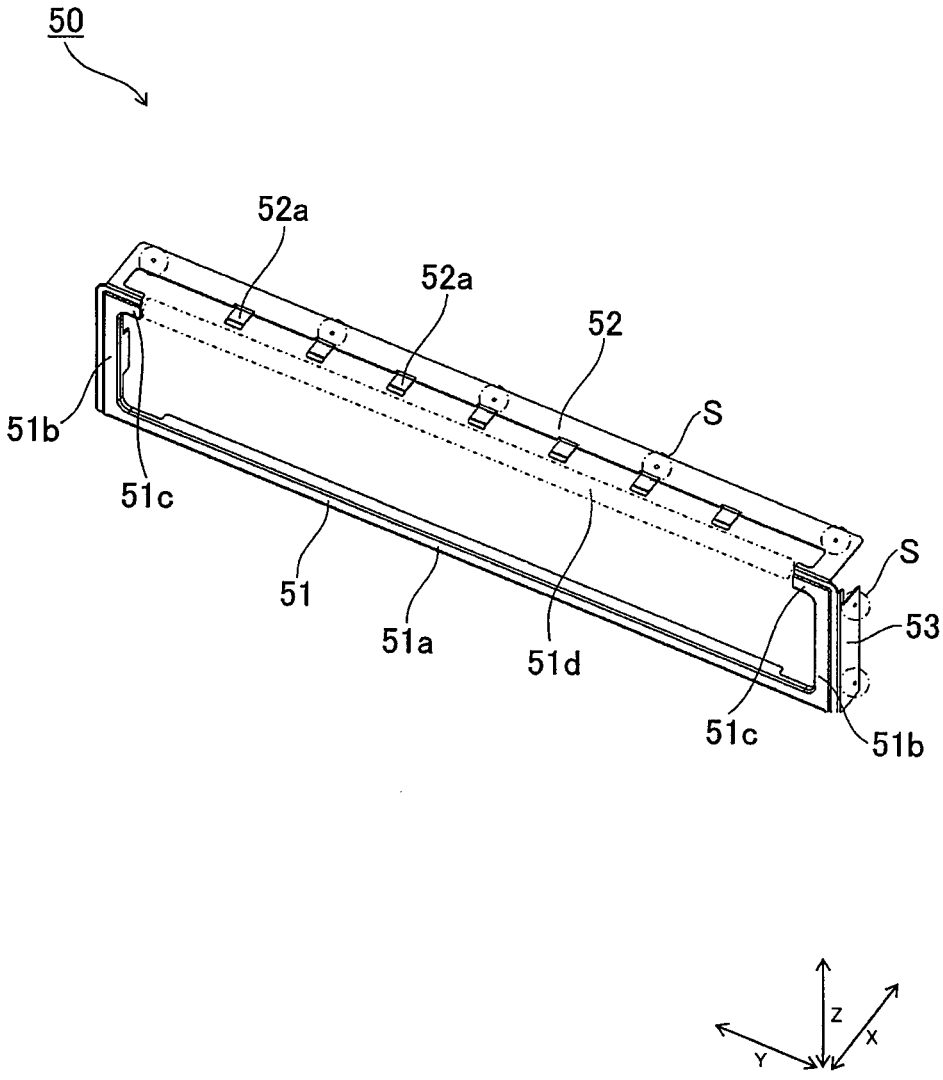
FIG. 6 is a perspective view illustrating a front surface member.

As illustrated in FIG. 6, the front surface member 50 is shaped by bending a sheet metal formed into a predetermined shape at predetermined positions.

The front surface member 50 is spot-welded at spot welding portions S illustrated in FIG. 6, thereby being joined to the body cover 30.

As illustrated in FIG. 6, the front surface member 50 includes the front frame section 51 for defining edge portions of the front opening portion 22, a rearward protrusion section 52, which protrudes rearward from the front frame section 51, a plurality of claw portions 52*a*, which protrude from the rearward protrusion section 52 toward the front surface side, and assembling plate sections 53 formed so as to extend rearward from the front frame section 51.

As illustrated in FIG. 6, the front frame section 51 includes a bottom surface-side frame portion 51*a* for defining an edge portion of the rectangular front opening portion 22 on a bottom surface side, two lateral surface-side frame portions 51*b* for defining edge portions of the front opening portion 22 on a lateral surface side, two top surface-side frame portions 51*c* for defining a part of the edge portion of the front opening portion 22 on a top surface side, and the top surface-side cutout portion 51*d* formed between the two top surface-side frame portions 51*c*. As illustrated in FIG. 6, the top surface-side cutout portion 51*d* is formed at a position corresponding to the edge portion of the front opening portion 22 on the top surface side so as to penetrate in the first direction X.

As illustrated in FIGS. 2 and 3, the bottom chassis 60 includes guide rollers 61 for guiding the drawer 70 in the first direction X, and foot portions 62 fixed to a bottom portion of the cash drawer body 20.

The bottom chassis 60 is fixed to the body cover 30 with screws.

As illustrated in FIG. 1, a cash tray 80 for containing the banknotes B and the coins (not shown) is mounted on the drawer 70.

Figure 10:
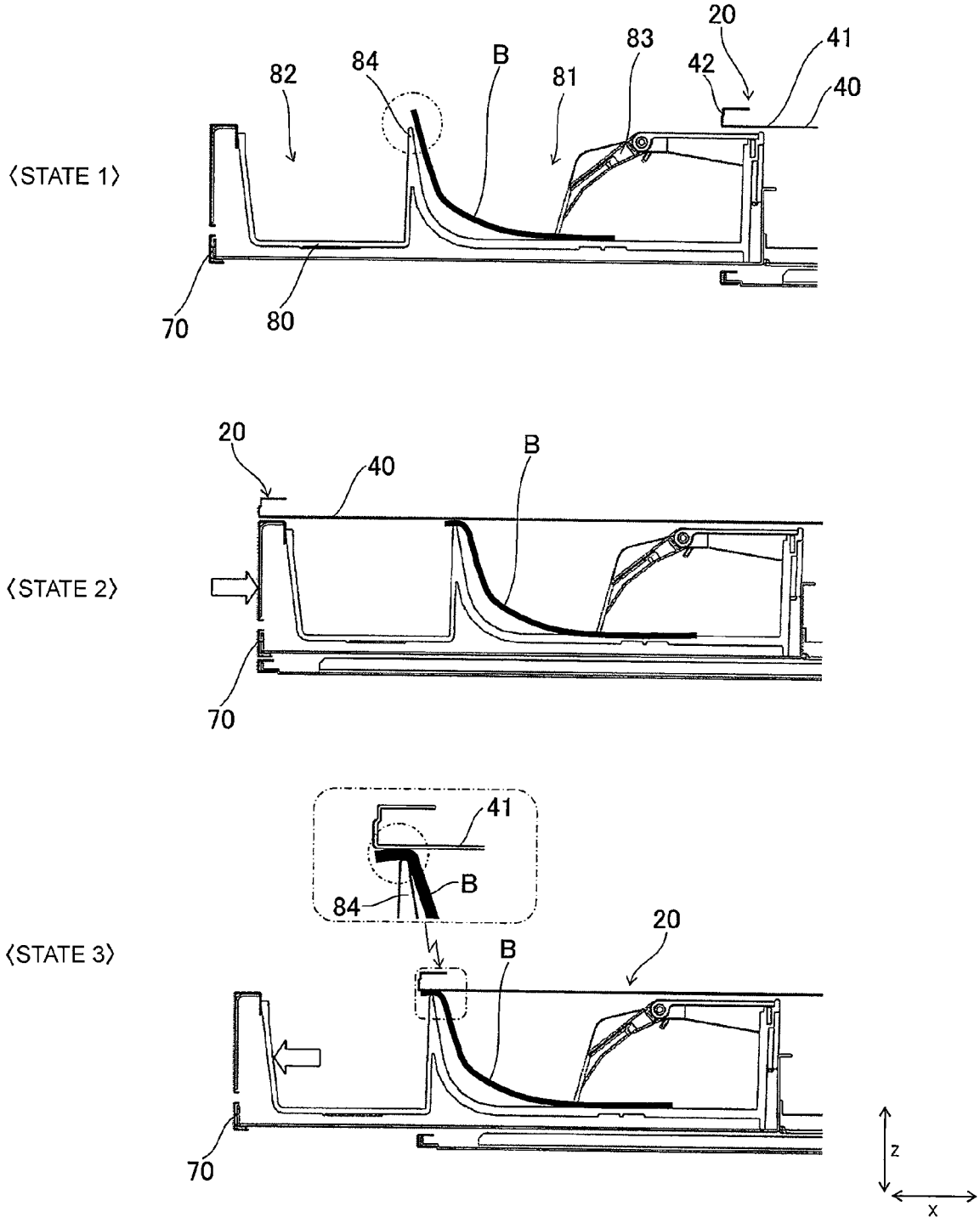
FIG. 10 is an explanatory view illustrating states of a banknote at the time when a drawer is moved in and out.
Figure 11:
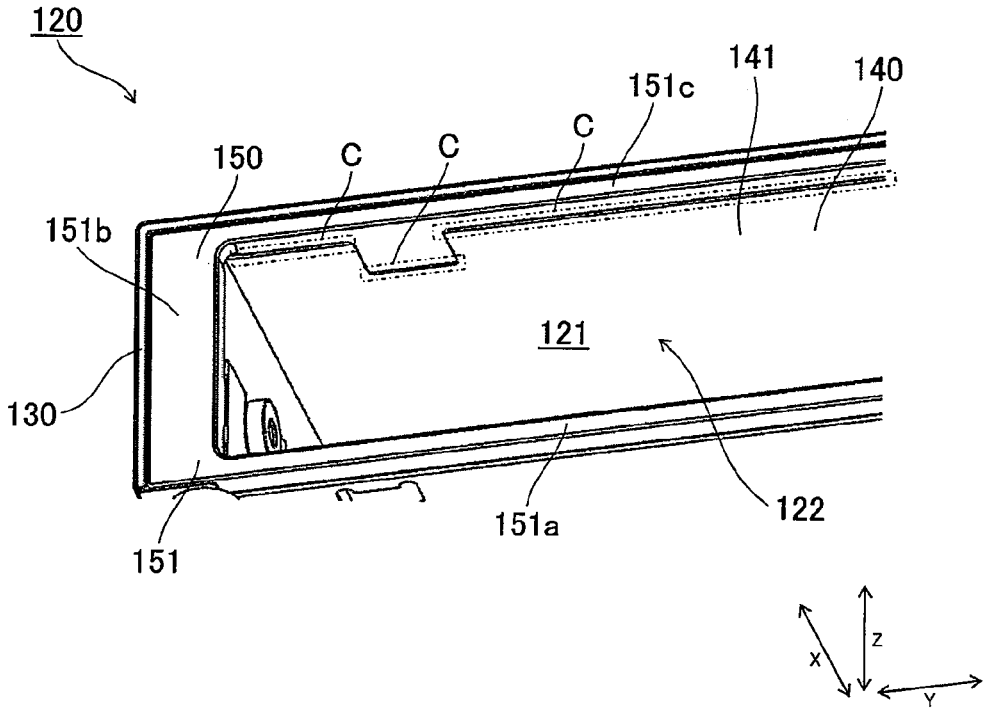
FIG. 11 is a perspective view illustrating a cash drawer body according to a reference example.
Figure 12:
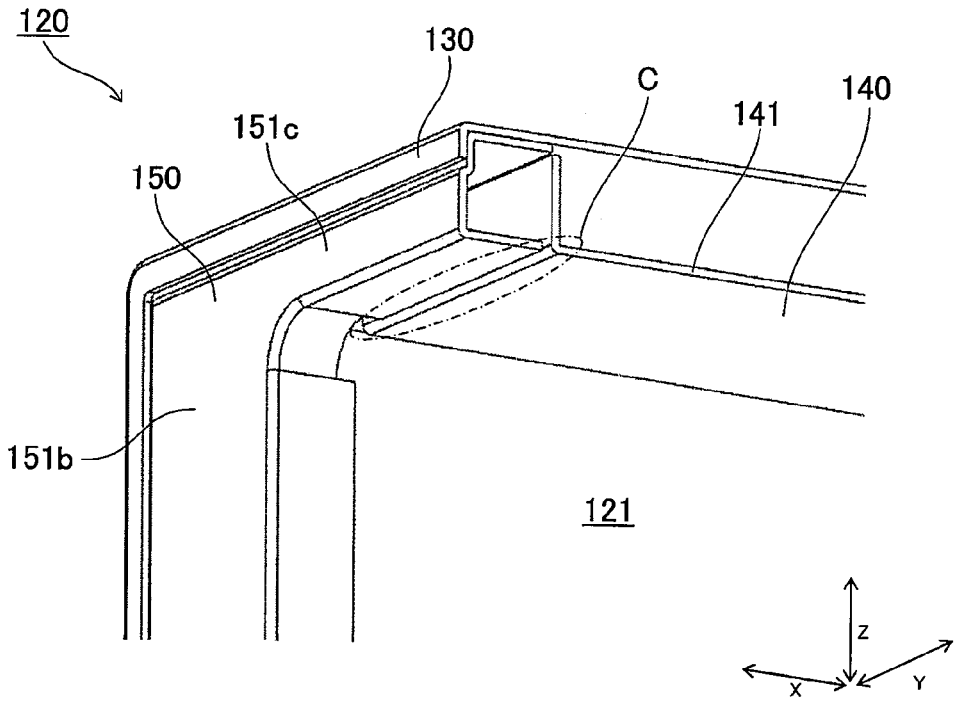
FIG. 12 is an explanatory view illustrating a cross section of the cash drawer body according to the reference example.
Figure 13:
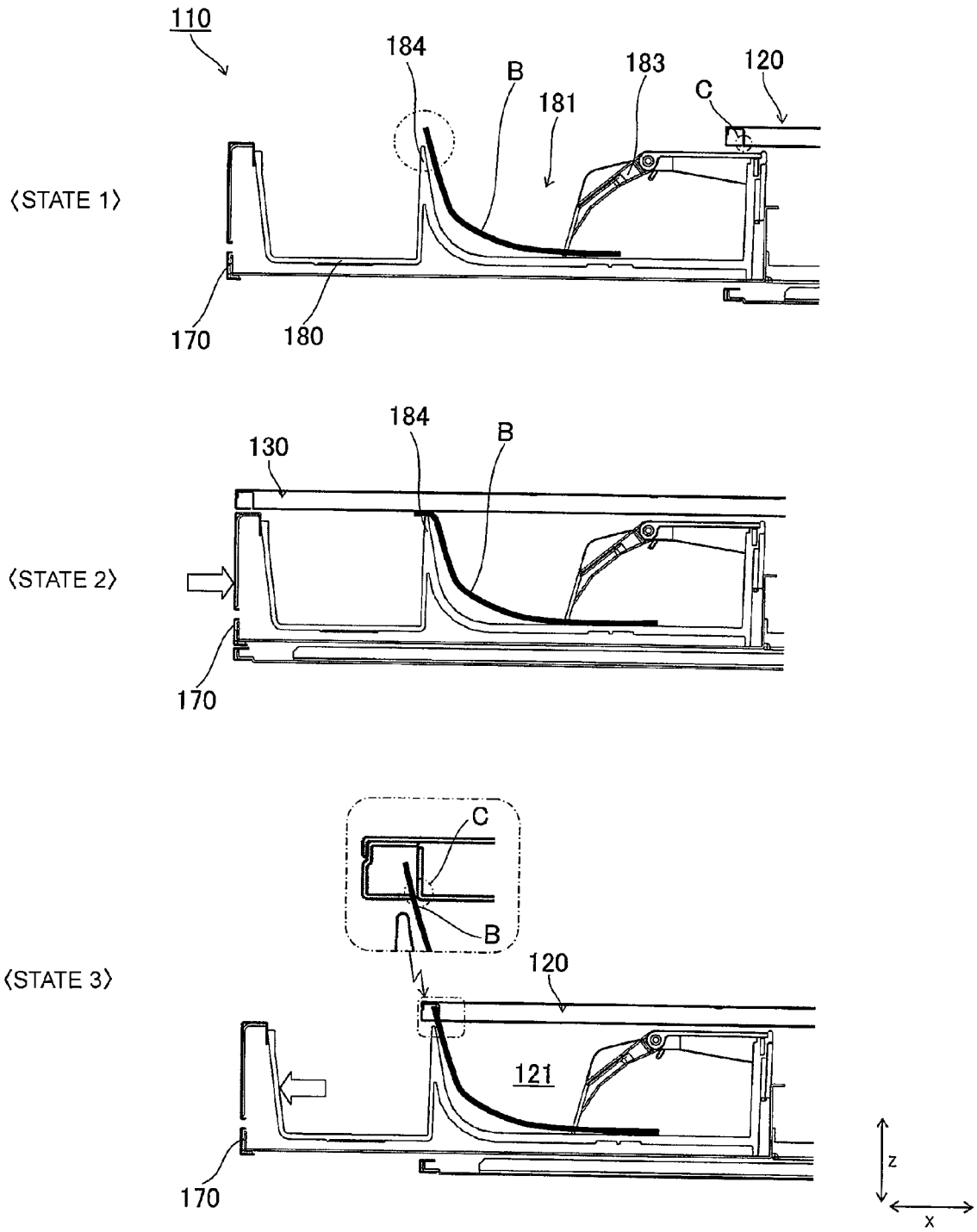
FIG. 13 is an explanatory view illustrating states of a banknote at the time when a drawer of the cash drawer according to the reference example is moved in and out.
Figure 14:
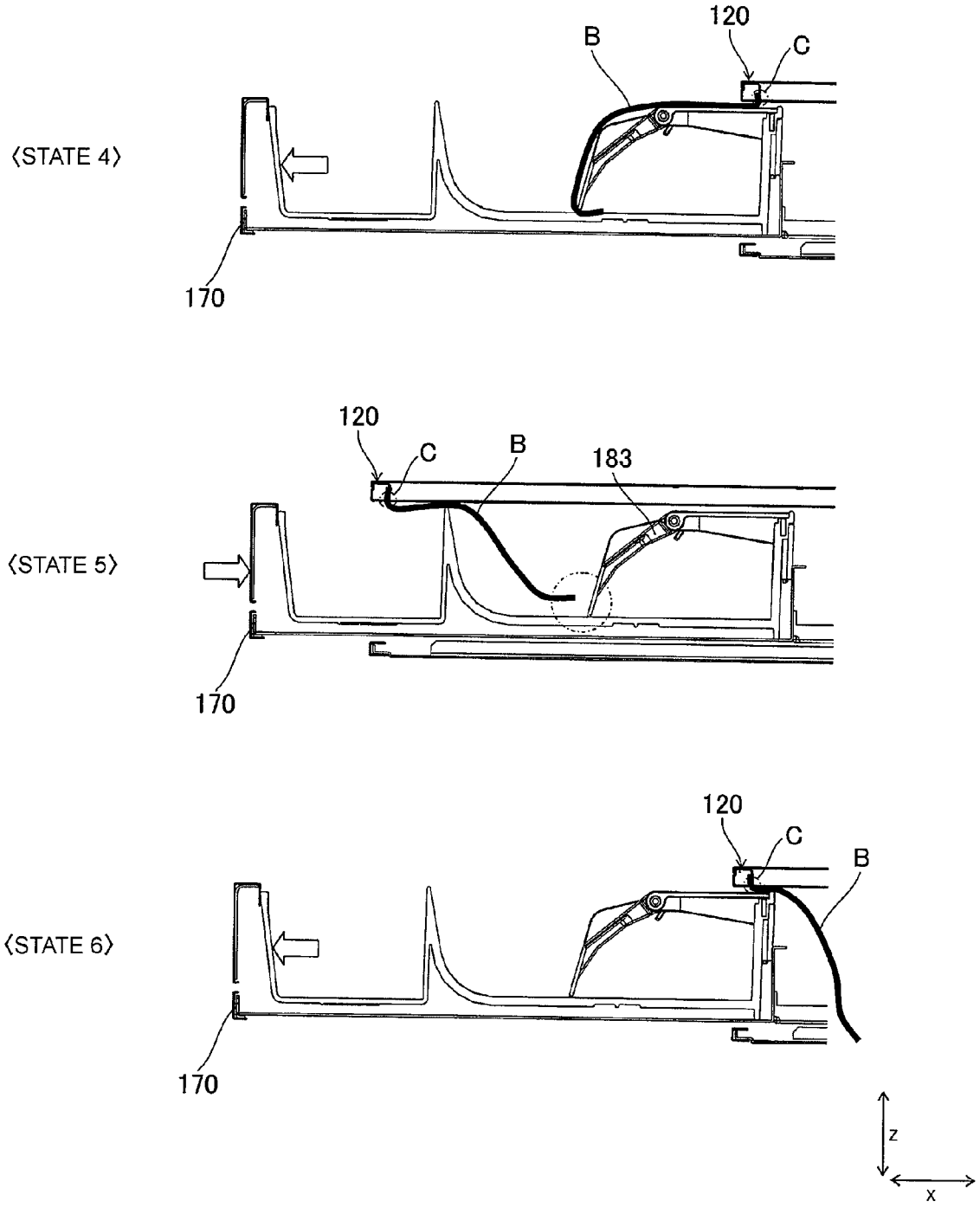
FIG. 14 is an explanatory view illustrating states of the banknote at the time when the drawer of the cash drawer according to the reference example is moved in and out.

As illustrated in FIGS. 1 and 10, the cash tray 80 includes the banknote container 81 for containing the banknotes B, a coin container 82 for storing the coins (not shown), banknote retainers 83 for retaining the banknotes B contained in the banknote container 81, and banknote guide portions 84 for guiding the banknotes B.

A solenoid (not shown) is actuated in response to an opening signal from a control unit (not shown) of the POS device (not shown), and then a lock mechanism (not shown) is unlocked in conjunction with the actuation of the solenoid (not shown). Then, the drawer 70 is pushed to the outside of the drawer accommodating portion 21 by urging means (not shown). Further, when an operator closes the drawer 70, the solenoid (not shown) is returned to its original position in conjunction with the lock mechanism (not shown), to thereby lock the drawer 70. Note that, the mechanism for moving the drawer 70 in and out is less relevant to this invention, and hence further details thereof are omitted herein.

Next, an assembling method for the cash drawer body 20 is described below with reference to FIGS. 7 to 9. Note that, in FIGS. 7 to 9, the illustration of the top surface-side cover section 31 of the body cover 30 is omitted.

Figure 7:
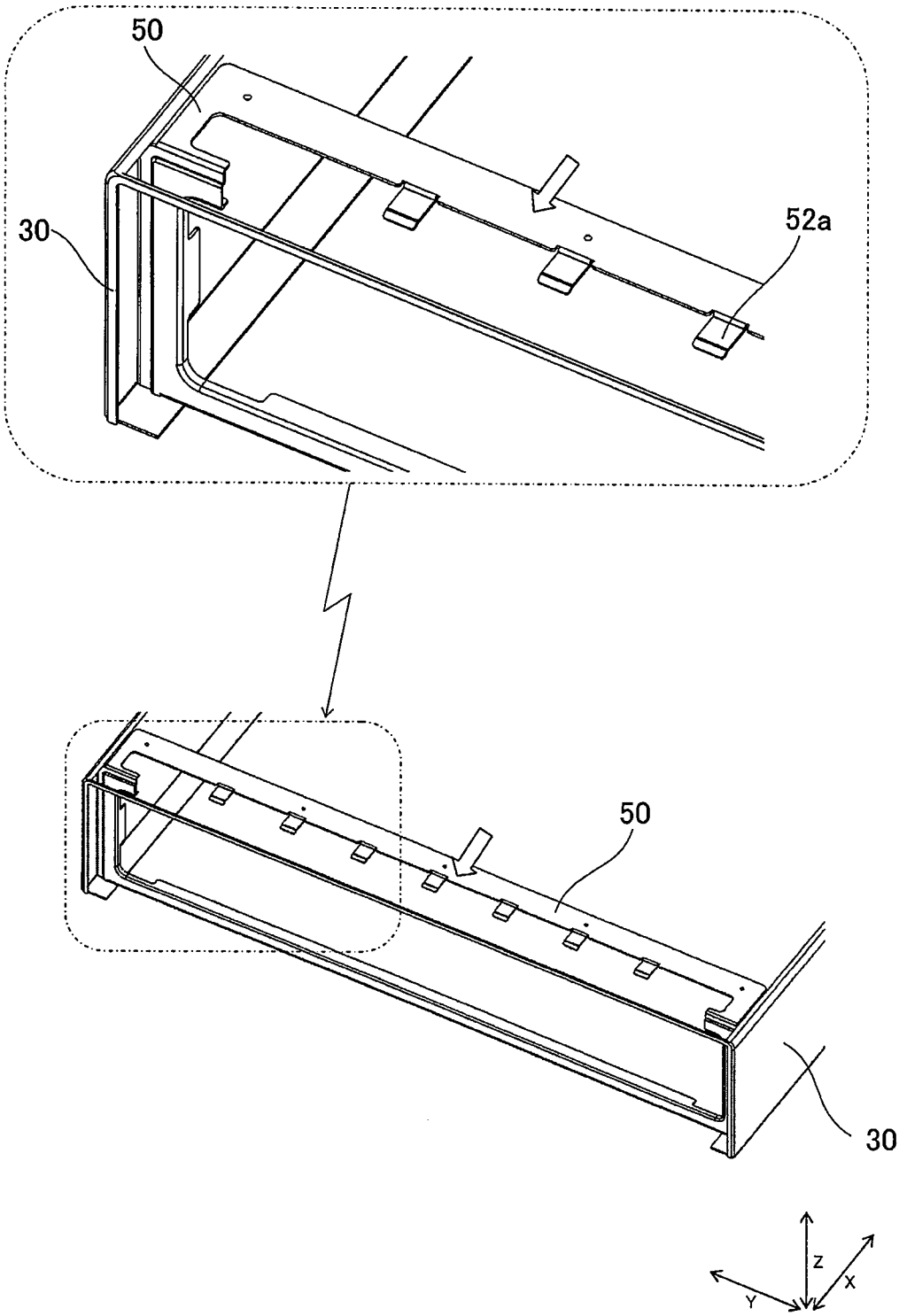
FIG. 7 is an explanatory view illustrating a first step of an assembling process for the cash drawer body.

First, as illustrated in FIG. 7, the front surface member 50 is slid from the rear side toward the front surface side relative to the body cover 30, to thereby mount the front surface member 50 at a predetermined position on the front surface side in the body cover 30.

Then, the body cover 30 and the front surface member 50 are spot-welded at the spot welding portions S illustrated in FIG. 6, to thereby join the body cover 30 and the front surface member 50 to each other. Note that, the spot welding of the body cover 30 and the front surface member 50 may be carried out at a different timing, for example, after the top surface member 40 is fixed to the body cover 30.

Figure 8:
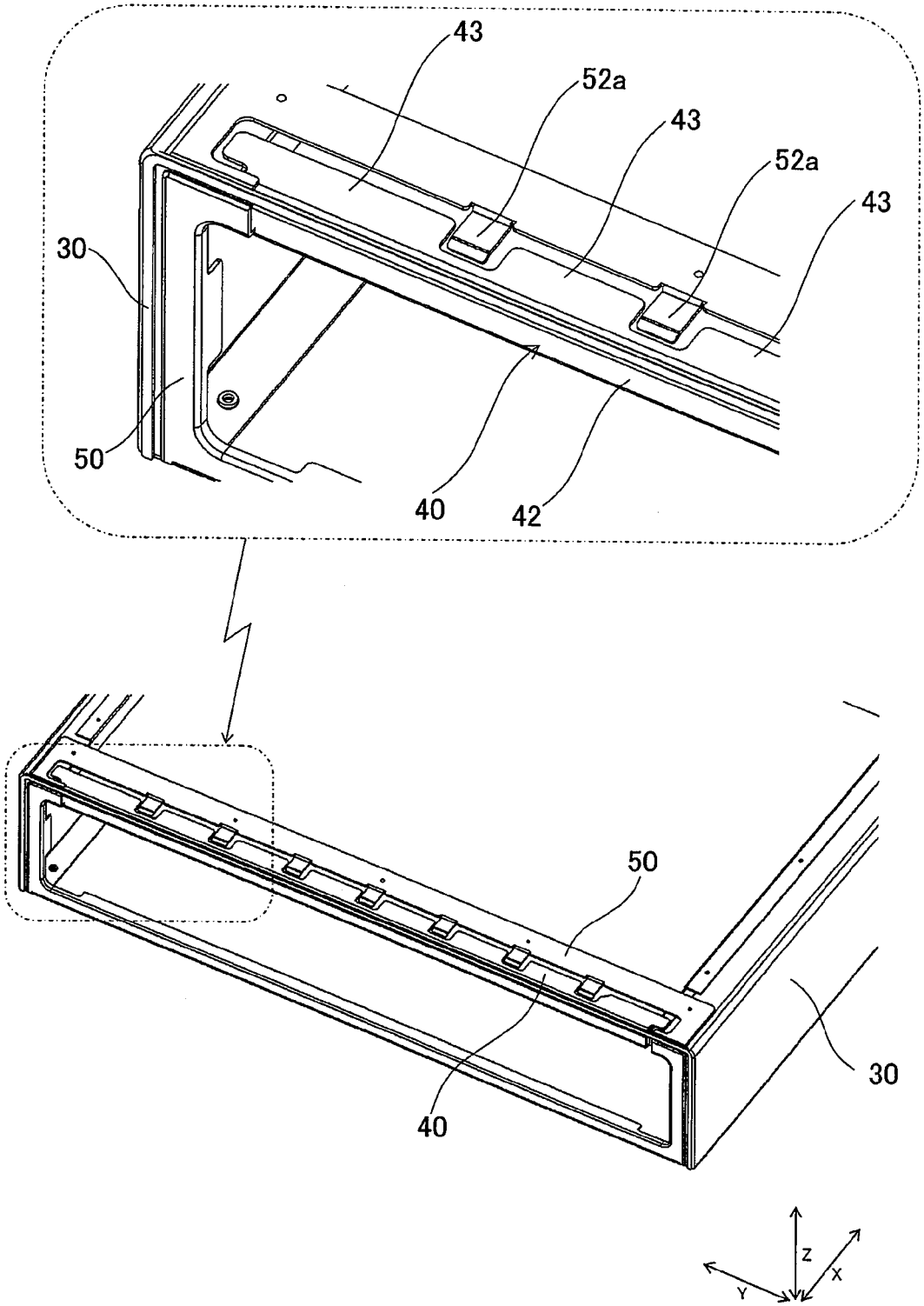
FIG. 8 is an explanatory view illustrating a second step of the assembling process for the cash drawer body.
Figure 9:
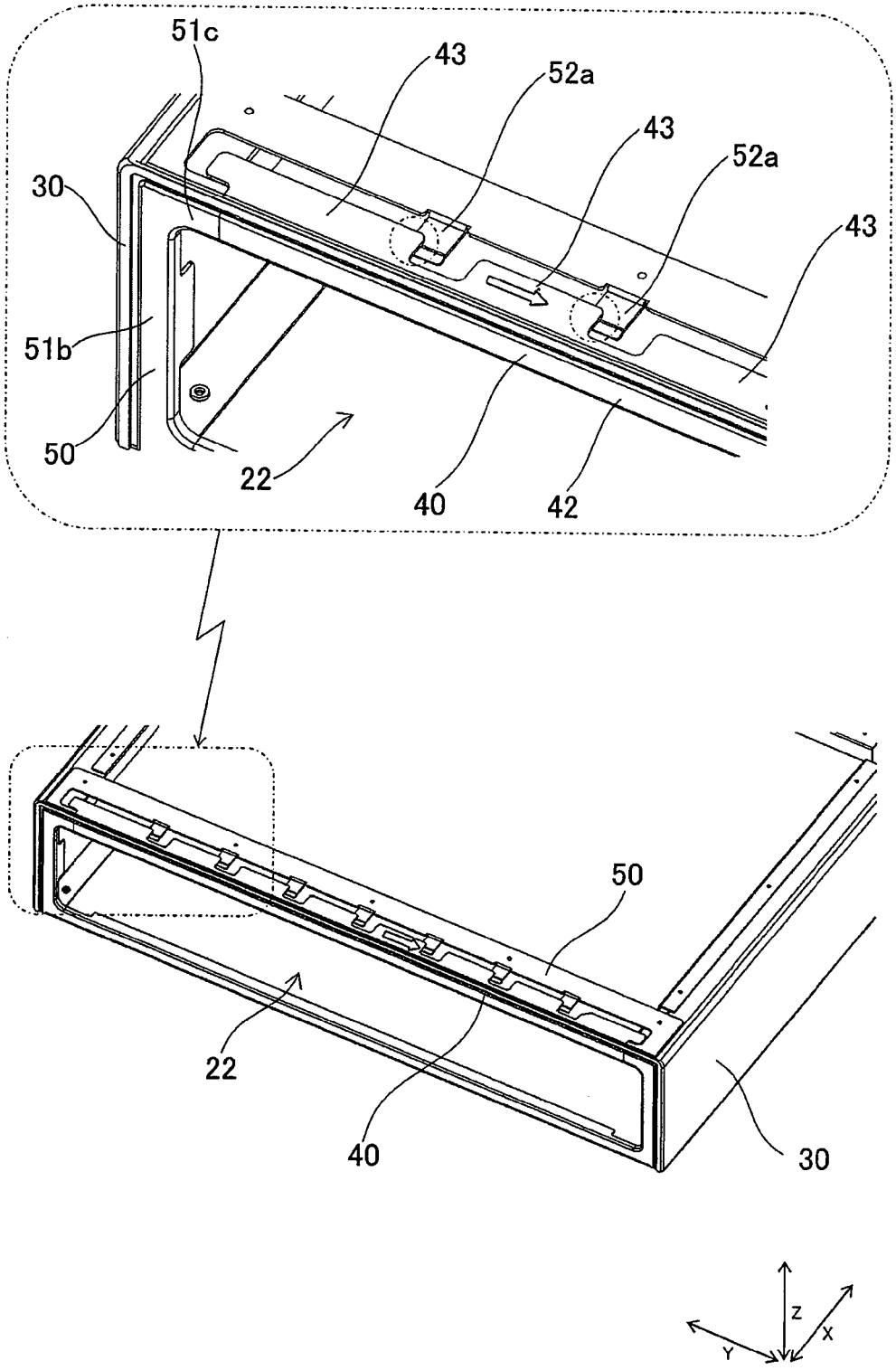
FIG. 9 is an explanatory view illustrating a third step of the assembling process for the cash drawer body.

Then, as illustrated in FIG. 8, the top surface member 40 is arranged at a predetermined position in the body cover 30, and then, as illustrated in FIG. 9, the top surface member 40 is slid laterally, to thereby hook the assembling protrusion sections 43 of the top surface member 40 onto the claw portions 52*a* of the front surface member 50. In this manner, temporary fixing of the top surface member 40 is completed.

Then, the body cover 30 and the top surface member 40 are spot-welded at the spot welding portions S illustrated in FIG. 5, to thereby join the body cover 30 and the top surface member 40 to each other. Note that, the spot welding of the body cover 30 and the top surface member 40 may be carried out at a different timing, for example, after the bottom chassis 60 is fixed to the body cover 30.

Then, the bottom chassis 60 is fixed to the body cover 30 with screws. In this manner, the assembling of the cash drawer body 20 is completed.

Next, referring to FIG. 10, description is given below of states of the banknote B at the time when the drawer 70 is moved into and out of the cash drawer body 20 of this embodiment. Note that, in FIG. 10, the illustration of the body cover 30 and the front surface member 50 is omitted.

First, during operation of the cash drawer 10, as indicated by <STATE 1> of FIG. 10, the banknote B may be retained by the banknote retainer 83 under a state in which a distal end of the banknote B protrudes to a position above an upper end of the banknote guide portion 84.

Then, under the state in which the banknote B protrudes to the position above the upper end of the banknote guide portion 184, the drawer 170 is returned into the cash drawer body 120 as indicated by <STATE 2> of FIG. 10, and then the drawer 170 is pulled out as indicated by <STATE 3> of FIG. 10.

In this case, in the cash drawer 10 of this embodiment, a seam extending in a direction being parallel to the top panel of the drawer accommodating portion 121 and intersecting the first direction X is not formed at the top surface of the drawer accommodating portion 121. Therefore, unlike the case of the cash drawer 110 of the reference example, in which the seam C extending in the direction being parallel to the top panel of the drawer accommodating portion 121 and intersecting the first direction X is formed at the top surface of the drawer accommodating portion 121, there is no risk of the loss of the banknote B, which may be caused by the situation where the banknote B is caught on the seam C.

In the cash drawer 10 of this embodiment, which is obtained as described above, the top surface-side cutout portion 51*d* is formed in the front frame section 51, and the edge portion of the top surface section 41 on the front surface side is inserted to the top surface-side cutout portion 51*d* of the front frame section 51 so as to reach the front surface side of the cash drawer body 20. Therefore, the front surface member 50 and the top surface member 40 can be coupled to each other without forming, as seen in the third direction Z orthogonal to the top surface of the drawer accommodating portion 21, the seam extending in the direction being parallel to the top surface of the drawer accommodating portion 21 and intersecting the first direction X in a region of the top surface of the drawer accommodating portion 21, through which the banknote container 81 passes when the drawer 70 is moved in and out. Thus, it is possible to avoid such a risk that, during the operation of the cash drawer 10, the banknote B contained in the banknote container 81 is caught on the seam formed at the top surface of the drawer accommodating portion 21. As a result, it is possible to prevent the loss of the banknote B, which may be caused by the situation where the banknote B is caught on the seam formed at the top surface of the drawer accommodating portion 21.

INDUSTRIAL APPLICABILITY

While this invention has been described above with reference to the embodiments, various modifications that a person skilled in the art can understand may be made to the configuration and details of this invention.

Further, this application is based on and claims the benefit of priority from Japanese Patent Application No. 2012-180532, filed on Aug. 16, 2012, the disclosure of which is incorporated herein by reference in its entirety.

The invention claimed is:

1. A cash drawer, comprising:

a drawer; and a cash drawer body for accommodating the drawer in a state of being movable in and out along a first direction, the drawer comprising a banknote container for containing a banknote, the cash drawer body comprising:

a drawer accommodating portion for accommodating the drawer;

a front opening portion formed at one end of the drawer accommodating portion and opened to an outside;

a top surface member comprising a top surface section for defining a top surface of the drawer accommodating portion; and a front surface member comprising a front frame section for defining an edge portion of the front opening portion, wherein the front frame section has a top surface-side cutout portion formed at a position corresponding to an edge portion of the front opening portion on the top surface side so as to penetrate in the first direction, wherein an edge portion of the top surface section of the top surface member on a front surface side is inserted to the top surface-side cutout portion of the front frame section so as to reach the front surface side of the cash drawer body, and wherein the front surface member and the top surface member are coupled to each other without forming, as seen in a direction orthogonal to the top surface of the drawer accommodating portion, at a position between the front surface member and the top surface member, a seam extending in a direction being parallel to the top surface of the drawer accommodating portion and intersecting the first direction in a region of the top surface of the drawer accommodating portion, through which the banknote container passes when the drawer is moved in and out.

2. The cash drawer according to claim 1, wherein the top surface member further comprises a frame section formed continuously with the edge portion of the top surface section on the front surface side, for defining the edge portion of the front opening portion together with the front frame section of the front surface member.

3. The cash drawer according to claim 1, wherein, in a direction parallel to the top surface of the drawer accommodating portion and orthogonal to the first direction, the top surface section of the top surface member has a width dimension for covering the banknote container of the drawer.

4. The cash drawer according to claim 1, wherein each of the top surface member and the front surface member is shaped by bending a sheet metal formed into a predetermined shape at a predetermined position.

5. The cash drawer according to claim 1, wherein the drawer comprises a banknote retainer for retaining the banknote contained in the banknote container.

* * * * *

UNITED STATES PATENT AND TRADEMARK OFFICE

CERTIFICATE OF CORRECTION

PATENT NO. : 9,159,204 B2
APPLICATION NO. : 14/419162
DATED : October 13, 2015
INVENTOR(S) : Shinichirou Yonemaru It is certified that error appears in the above-identified patent and that said Letters Patent is hereby corrected as shown below:

In the specification
Column 1, Line 37: Delete "JP-A-563-268091" and insert -- JP-A-S63-268091 --

Signed and Sealed this
Twenty-third Day of February, 2016

Michelle K. Lee

Michelle K. Lee
*Director of the United States Patent and Trademark Office*